US006837376B2

(12) United States Patent
Pauli

(10) Patent No.: US 6,837,376 B2
(45) Date of Patent: Jan. 4, 2005

(54) CONTAINER FOR MONITORING CONSUMPTION OF SELECTED CHEMICAL COMPOUNDS OF A LIQUID

(76) Inventor: Donna Kay Pauli, 1437 Haynes St., Barberton, OH (US) 44203

( * ) Notice: Subject to any disclaimer, the term of this patent is extended or adjusted under 35 U.S.C. 154(b) by 211 days.

(21) Appl. No.: 10/328,501

(22) Filed: Dec. 24, 2002

(65) Prior Publication Data

US 2004/0118733 A1 Jun. 24, 2004

(51) Int. Cl.[7] ..... B65D 39/00
(52) U.S. Cl. ..... 206/459.5; 426/87; 215/230
(58) Field of Search ..... 206/459.5, 831; 215/230; 426/87; 40/310

(56) References Cited

U.S. PATENT DOCUMENTS

| | | | | |
|---|---|---|---|---|
| 2,762,526 A | | 9/1956 | Gilmour | |
| 4,961,521 A | | 10/1990 | Eckman | |
| 5,402,679 A | | 4/1995 | Vogel | |
| 5,607,078 A | | 3/1997 | Nordberg et al. | |
| 5,791,528 A | | 8/1998 | Robbins, III et al. | |
| 5,881,894 A | | 3/1999 | Gargano | |
| 5,896,990 A | | 4/1999 | Barzana | |
| 6,093,430 A | * | 7/2000 | Gupta | 426/115 |
| 6,572,904 B2 | * | 6/2003 | Rhee | 426/87 |

* cited by examiner

*Primary Examiner*—Jacob K. Ackun, Jr.
(74) *Attorney, Agent, or Firm*—Dale J. Ream

(57) ABSTRACT

A container for monitoring consumption of a volume of liquid or selected chemical compounds thereof includes a container body having a construction defining an open top. A first set of linear scale indicia is positioned on a container side wall along with a corresponding first set of graduated numeric indicia for indicating an amount of liquid consumption. Second sets of corresponding linear scale and graduated numeric indicia are positioned on another side of the container body for indicating consumption of a preselected chemical compound of the liquid. Thus, a user is able to visually determine the relationship between consumption of a particular volume of the liquid and consumption of an amount of a preselected chemical compound thereof. This enables a user to modify consumption habits if desired. The container may include a third set of indicia, the second and third sets being distinguished by different shape and color components.

20 Claims, 3 Drawing Sheets

CONTAINER FOR MONITORING CONSUMPTION OF SELECTED CHEMICAL COMPOUNDS OF A LIQUID

BACKGROUND OF THE INVENTION

This invention relates generally to liquid containers and dispensers and, more particularly, to a container for selectively monitoring consumption of an overall volume of a liquid or consumption of an amount of a preselected chemical compound of the liquid.

Various devices have been proposed in the art for measuring a volume of a solid or liquid substance dispensed from a container. For example, measuring spoons or cups are used for measuring a quantity of a substance being removed from a container. Although assumably effective for their intended purposes, the existing devices do not provide a convenient means of indicating on the container itself a volume of a liquid that has been consumed or that will be consumed momentarily. Further, the existing devices do not provide a structure by which a user may visually correlate consumption of amounts of preselected chemical compounds of the substance with consumption of a predetermined volume of the overall substance.

Therefore, it is desirable to have a container for monitoring consumption of a volume of a liquid as well as consumption of an amount of a chemical compound of the liquid. Further, it is desirable to have a container for visually correlating consumption of an amount of a chemical compound with consumption of an overall amount of a liquid containing the compound. In addition, it is desirable to have a container that enables a consumer to regulate eating behavior based on consumption of one or more chemical compounds.

SUMMARY OF THE INVENTION

Consumers who are health conscious or who have certain medical needs desire to know the specific amount of certain chemical compounds that they are ingesting when consuming certain substances. For example, persons with diabetes, high blood pressure, or weight goals may desire to be sure that they do not consume more than an exact serving size amount of salad dressing. In addition, such consumers may know the exact amount of a particular chemical compound, e.g. sugar, fat, or carbohydrates, that they can safely consume but are typically without any way to accurately consume only the desired amount of the compound. Since the correlation between chemical compounds and a substance's serving size is specific to the substance, conventional measuring devices are ineffective.

Accordingly, a container for selectively monitoring the overall consumption of a liquid or the consumption of a particular chemical compound found in the liquid includes a container body having a bottom and side walls defining an open top. A first set of linear scale indicia is positioned on a first side wall and extends between the bottom and open top. A first set of graduated numeric indicia corresponding to the first set of linear scale indicia is also positioned on the first side wall. Preferably, the first sets of indicia indicate numbers of serving sizes or portions of serving sizes relative to a liquid contained within the container body. Second sets of linear scale and graduated numeric indicia are positioned on a second side wall of the container body and are indicative of amounts of a preselected chemical compound within the overall liquid composition within the container. Accordingly, a consumer may gauge consumption of the liquid using either the first or second scales, or both. Of course, additional scales specific to other chemical compounds within the liquid may be positioned on the container body as well.

Further, a plurality of nutritional data may be adhered to the container body. The indicia of each of the scales specific to amounts of preselected chemical compounds may include components of shape and color indicia, whereby to visually distinguish the scales. These shape and color patterns are also positioned adjacent corresponding nutritional data so as to visually associate that data with the appropriate chemical compound scale. This enables a consumer to make fast and accurate correlations between overall consumption and specific chemical compound consumption. Being able to make a correlation between the scales is important for when the consumer is in use of another container not having a chemical compound scale. In this case, the consumer may use the correlation to dispense an accurate portion of a complete serving.

Therefore, a general object of this invention is to provide a container for monitoring overall consumption of a substance.

Another object of this invention is to provide a container, as aforesaid, for monitoring consumption of at least one chemical compound of the substance so that eating behavior may be based selectively on either scale.

Still another object of this invention is to provide a container, as aforesaid, which enables a user to correlate consumption of an amount of a substance with consumption of an amount of a chemical compound thereof.

Yet another object of this invention is to provide a container, as aforesaid, which provides shape and color components to chemical compound scales for accelerating distinctions thereof.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1A:
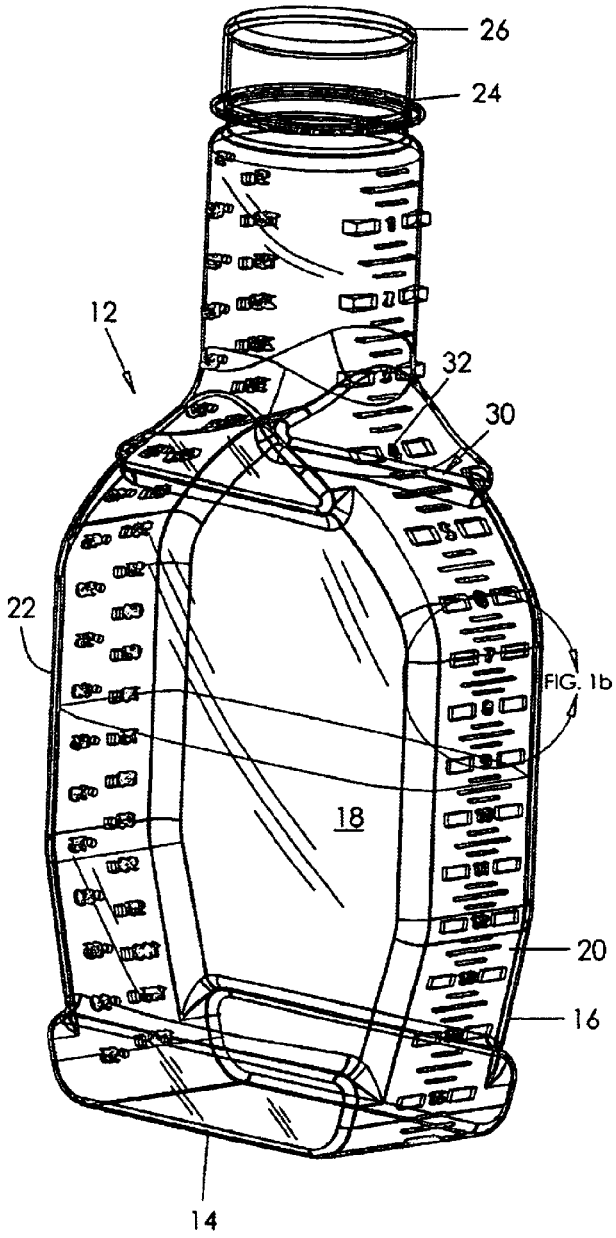
FIG. 1*a* is a rear perspective view of a container according to a preferred embodiment of the present invention.

A container 10 for selectively monitoring the overall consumption of a liquid or the consumption of a chemical compound found in the liquid according to a preferred embodiment of the present invention will now be described in detail with reference to FIGS. 1*a* through 3 of the accompanying drawings.

The container 10 includes a container body 12 having a closed bottom 14, front 16 and back 18 walls extending upwardly from the bottom 14 with first 20 and second 22 side walls connecting the front 16 and back 18 walls.

Preferably, the container body 12 is integrally constructed such that the front, back, and side walls may be considered a to continuous side wall. The front 16 and back 18 walls and first 20 and second 22 side walls cooperate to define an open top 24 through which a substance, such as salad dressing or the like, may be added to or dispensed from the container body 12. A cap 26 may be releasably coupled to the container body 12, e.g. in threaded or friction-fit engagement, so as to selectively cover the open top 24.

Figure 1B:
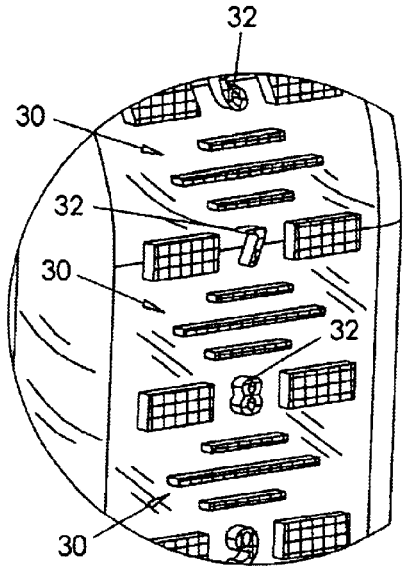
FIG. 1*b* is a perspective view on an enlarged scale of a first side wall of the container as in FIG. 1*a;*

A first set of linear scale indicia 30 is positioned on the first side wall 20 of the container body 12 (FIG. 1*a*). The first set of linear scale indicia 30 extends between the bottom 14 and open top 24, each indicium thereof being spaced a predetermined distance from an adjacent indicium (FIG. 1*b*). A first set of graduated numerical indigia 32 is also positioned on the first side wall 20 of the container body 12 and corresponds to the first set of linear scale indicia 30 (FIGS. 1*a* and 1*b*). The numerical indicia begins adjacent the open top 24 and numerically ascends as the linear scale indicia 30 descends toward the container body bottom 14. Therefore, as a volume of a liquid is dispensed or poured out of the container body 12, a consumer is able to read the total number of units that has been removed. Preferably, the first set of linear scale indicia 30 corresponds to a "serving size" of a liquid within the container body 12. So as liquid is poured from the container body 12 for consumption thereof, the consumer is visually informed as to when a complete or partial serving size has been dispensed. While the first sets 30, 32 of linear scale and graduated numeric indicia may be imprinted on the first side wall 20, they are preferably molded therein as an integral construction so that they may have a raised construction for enhanced visual effect.

A second set of linear scale indicia 34 is positioned on the second side wall 22 of the container body 12 in a substantially similar construction as described above (FIGS. 2*a* and 2*b*). The second set of linear scale indicia 34 extends between the open top 24 and the bottom 14 of the container body 12. Further, a second set of graduated numerical indicia 36 is positioned on the second side wall 22 of the container body 12 and corresponds to the second set of linear scale indicia 34. The second set of graduated numerical indicia 36 begins adjacent the open top 24 and ascends numerically as it corresponds with descending linear scale indicia. The second sets of indicia 34, 36 specifically correspond to a preselected chemical compound, e.g. total carbohydrates, of the substance within the container body 12 and are spaced apart at predetermined intervals accordingly. It can be seen, therefore, that a consumer concerned with not consuming more than a certain unit amount of the preselected chemical compound, is able to dispense the desired amount more accurately using the second sets of indicia than by using the standard "serving size" first sets of indicia. It should also be appreciated that the combination of first and second scale sets enables the consumer to correlate exactly and visually how much of a serving size may be consumed without exceeding the desired amount of the preselected chemical compound.

A third set of linear scale indicia 40 and corresponding graduated numerical indicia 42 may also be positioned on the second side wall 22 of the container body 12 adjacent the second sets 34, 36 of linear scale and graduated numerical indicia and in a substantially similar manner. The third sets 40, 42 specifically correspond to another preselected chemical compound, e.g. sugar content, of the substance contained within the container body 12. Therefore, by utilizing the third scale, a consumer concerned with limiting consumption of the substance to a particular amount of another preselected chemical compound is now able to dispense a desired amount of the overall substance more accurately than with a serving size consumption scale alone.

Figure 3:
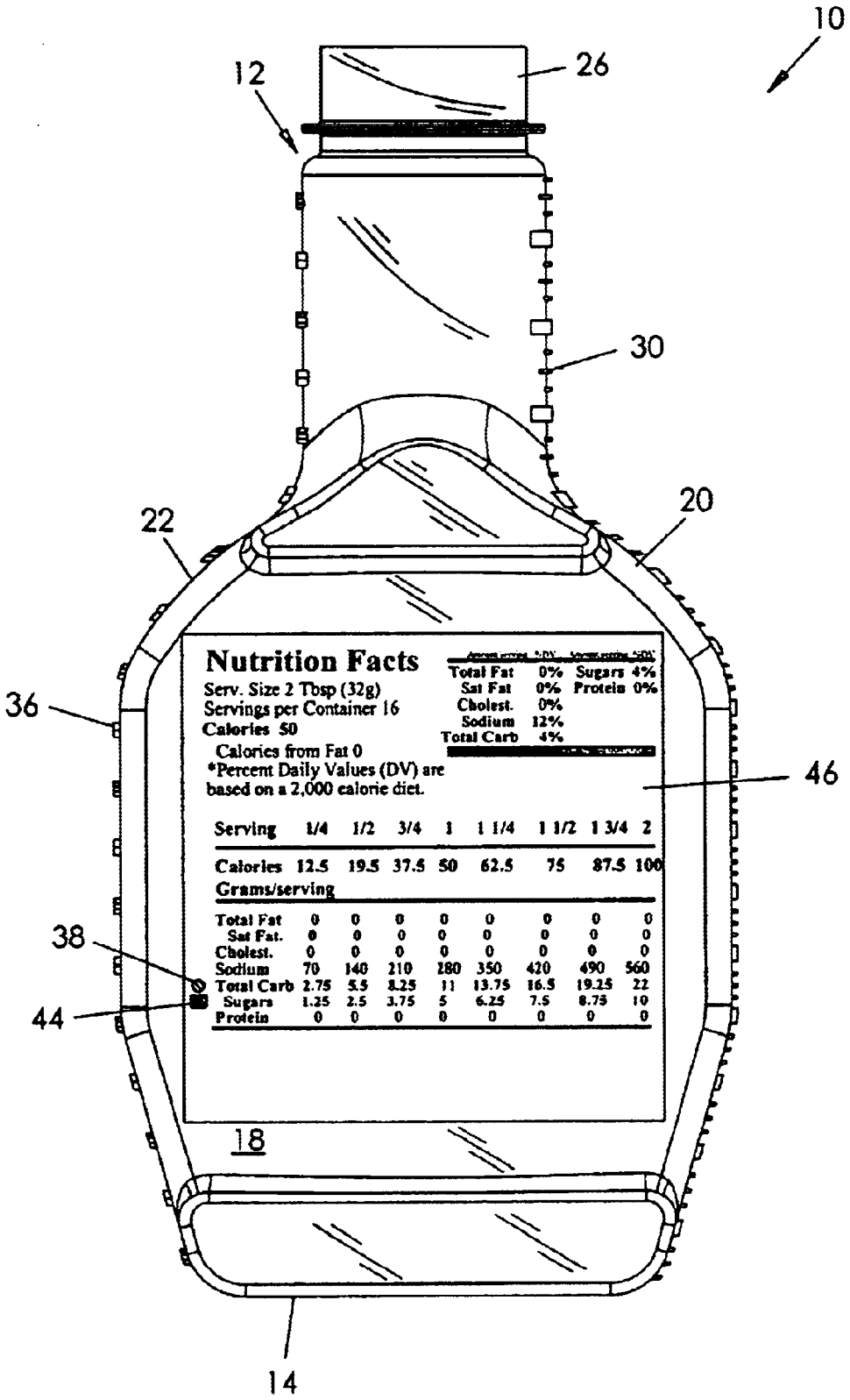
FIG. 3 is a rear view of the container as in FIG. 1*a*, with the addition of a plurality of nutritional indicia.

A plurality of nutritional indicia 46 may be positioned on the back wall 18 of the container body 12, such as with a label adhered thereto (FIG. 3). The nutritional indicia 46 includes, among other things, a recommended serving size and a breakdown of the number of grams of preselected chemical compounds per serving or predetermined portions thereof. Of course, the first sets 30, 32 of linear scale and graduated numeric indicia provided on the first side wall 20 of the container body 12 make it unnecessary for a consumer to use a tablespoon or other measuring device in order to accurately dispense a serving size portion. However, the utility of the nutritional indicia 46 is lacking when a consumer desires to consume a particular amount of a preselected chemical compound, but that desired amount does not match up with an amount of that compound in a serving size or predetermined portion thereof. In such a case, the preselected chemical compound scales (i.e. the second and third sets of linear scale and graduated numerical indicia) provide the needed utility.

Figure 2A:
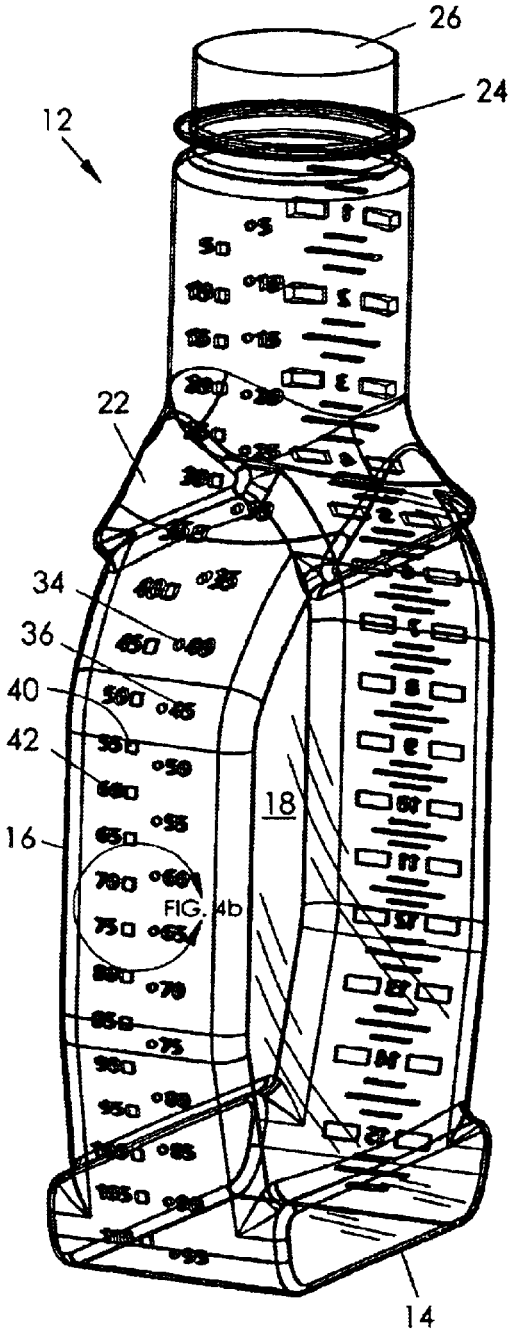
FIG. 2*a* is a perspective view from another angle of the container as in FIG. 1*a;*
Figure 2B:
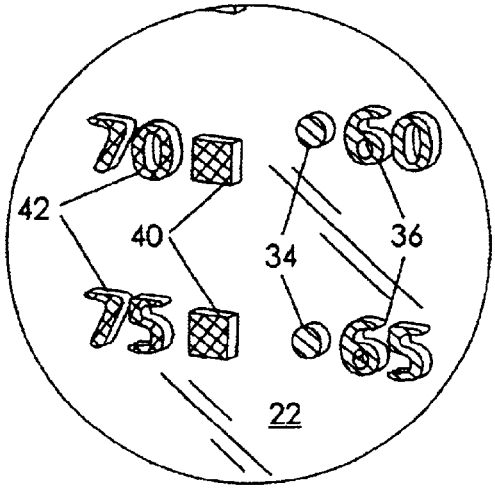
FIG. 2*b* is a perspective view on an enlarged scale of a second side wall of the container as in FIG. 2*a*.

In addition, each linear scale indicium of the second set of linear scale indicia includes two corresponding components. More particularly, one such component is color indicia and another component is shape indicia. In other words, instead of utilizing conventional scale hash marks, the first set of linear scale indicia presents a plurality of marks having a uniform shape and color. By way of example, each indicium of the second set of linear scale indicia 34 includes a circular shape indicia and a first color pattern (FIG. 2*b*). A second set identifier 38 having a shape and color corresponding to the shape and color components of the second set of linear scale indicia 34 is imprinted on the plurality of nutritional indicia 46 adjacent a corresponding preselected chemical compound (FIG. 3).

Similarly, each indicium of the third set of linear scale indicia 40 includes two components, those components being shape and color indicia. In FIG. 2*b*, the third set indicium components are illustrated as a square shape indicia and a second color pattern. A third set identifier 44 having a shape and color corresponding to the shape and color components of the third set of linear scale indicia 40 is imprinted on the plurality of nutritional indicia 46 adjacent a corresponding preselected chemical compound (FIG. 3). It is understood that the shape and color indicia of the second set components are different than the shape and color indicia of the third set components (FIG. 2*b*). Likewise, the second set identifier 38 is different than the third set identifier 44 (FIG. 3). It should be appreciated that the shape and color indicia enable a consumer to quickly and accurately identify, distinguish, and correlate consumption of predetermined chemical compounds relative to overall substance consumption.

In use, the construction described above may be in the form of a salad dressing bottle although containers for other liquids or substances may also be constructed. The first sets 30, 32 of linear scale and corresponding graduated numerical indicia may be utilized by a consumer who is primarily concerned with consuming only a single or partial serving of a liquid in the container body 12. The first set of graduated numerical indicia 32 also provides a consumer with knowledge of how many servings have been dispensed from the container body 12 and how many remain. However, a consumer concerned with limiting consumption of the liquid according to a predetermined amount of a particular chemical compound may monitor such consumption using the second sets 34, 36 or third sets 40, 42 of linear scale and graduated numerical indicia. The first 20 and second 22 set identifiers allow these correlations to be made quickly and accurately. Further, it should be appreciated that being able to make a correlation between the scales is important for when the consumer is in use of another container not having a chemical compound scale. In this case, the consumer may use the correlation to dispense an accurate partial portion of a complete serving.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A container for use in selectively monitoring consumption of a volume of liquid from the container or consumption of an amount of selected chemical compounds in said liquid, said container comprising:

a container body having a bottom and a continuous side wall extending upwardly from said bottom, said side wall defining an open top;

a first set of linear scale indicia on said side wall between said bottom and said open top, each of said first set of linear scale indicia having a predetermined distance therebetween;

a first set of graduated numerical indicia corresponding to said first set of linear scale indicia beginning at said open top; and a plurality of nutritional indicia situated on said side wall adjacent said first set of linear scale indicia, said plurality of nutritional indicia being indicative of quantities of chemical compounds in said liquid corresponding to said first set of graduated numerical indicia.

2. The container as in claim 1 wherein said first set of graduated numerical indicia is indicative of a number of servings that have been consumed.

3. The container as in claim 1 further comprising:

a second set of linear scale indicia on said side wall between said bottom and said open top, each of said second set of linear scale indicia having a predetermined distance therebetween; and a second set of graduated numerical indicia corresponding to said second set of linear scale indicia beginning adjacent said open top of said container, said second set of graduated numerical indicia being indicative of an amount of a preselected chemical compound in said liquid that has been consumed.

4. The container as in claim 3 wherein:

each indicium of said second set of linear scale indicia includes two corresponding second set components, one said second set component being color indicia and another said second set component being shape indicia; and said corresponding second set components being additionally imprinted adjacent a corresponding nutritional indicium of said plurality of nutritional indicia, whereby to associate said corresponding nutritional indicium with said second sets of linear and graduated numerical scale indicia.

5. The container as in claim 3 further comprising:

a third set of linear scale indicia on said side wall between said bottom and said open top, each of said third set of linear scale indicia having a predetermined distance therebetween; and a third set of graduated numerical indicia corresponding to said third set of linear scale indicia and beginning adjacent said open top of said container, said third set of graduated numerical indicia being indicative of an amount of another preselected chemical compound in said liquid that has been consumed.

6. The container as in claim 5 wherein:

each indicium of said third set of linear scale indicia includes two corresponding third set components, one said third set component being color indicia and another said third set component being shape indicia; and said corresponding third set components being additionally imprinted adjacent a corresponding nutritional indicium of said plurality of nutritional indicia, whereby to associate said corresponding nutritional indicium with said third sets of linear and graduated numerical scale indicia.

7. The container as in claim 4 further comprising:

a third set of linear scale indicia on said side wall between said bottom and said open top, each of said third set of linear scale indicia having a predetermined distance therebetween; and a third set of graduated numerical indicia corresponding to said third set of linear scale indicia and beginning adjacent said open top of said container, said third set of graduated numerical indicia being indicative of an amount of another preselected chemical compound in said liquid that has been consumed.

8. The container as in claim 7 wherein:

each indicium of said third set of linear scale indicia includes two corresponding third set components, one said third set component being color indicia different than said color indicia of said corresponding second set components and another said third set component being shape indicia different than said shape indicia of said corresponding second set components; and said corresponding third set components being additionally imprinted adjacent a respective nutritional indicium of said plurality of nutritional indicia, whereby to associate said respective nutritional indicium with said third sets of linear and graduated numerical indicia.

9. The container as in claim 1 further comprising a cap releasably coupled to a free edge of said continuous side wall for selectively covering said open top.

10. A container for use in selectively monitoring consumption of a volume of a liquid from the container or consumption of an amount of preselected chemical compounds in said liquid, said container comprising:

a container body having a bottom and front and back walls extending upwardly from said bottom with first and second side walls connecting said front and back walls, said front, back, first, and second side walls defining an open top;

a first set of linear scale indicia on said first side wall between said bottom and said open top, each of said first set of linear scale indicia having a predetermined distance therebetween;

a first set of graduated numerical indicia positioned on said first side wall and corresponding to said first set of linear scale indicia beginning at said open top;

a second set of linear scale indicia positioned on said second side wall between said bottom and said open top, each of said second set of linear scale indicia having a predetermined distance therebetween; and a second set of graduated numerical indicia positioned on said second side wall and corresponding to said second set of linear scale indicia beginning adjacent said open top of said container, said second set of graduated numerical indicia being indicative of an amount of a preselected chemical compound in said liquid that has been consumed.

11. The container as in claim 10 further comprising a plurality of nutritional indicia positioned on said back wall of said container body, said plurality of nutritional indicia being indicative of quantities of chemical compounds in said liquid in proportional correspondence to said first set of graduated numerical indicia.

12. The container as in claim 10 wherein said first set of graduated numerical indicia is indicative of a number of servings that have been consumed.

13. The container as in claim 11 wherein:

each indicium of said second set of linear scale indicia includes two corresponding second set components, one said second set component being color indicia and another said second set component being shape indicia; and said corresponding second set components being additionally imprinted adjacent a corresponding nutritional indicium of said plurality of nutritional indicia, whereby to associate said corresponding nutritional indicium with said second sets of linear and graduated numerical scale indicia.

14. The container as in claim 11 further comprising:

a third set of linear scale indicia positioned on said second side wall between said bottom and said open top, each of said third set of linear scale indicia having a predetermined distance therebetween; and a third set of graduated numerical indicia positioned on said second side wall and corresponding to said third set of linear scale indicia beginning adjacent said open top of said container, said third set of graduated numerical indicia being indicative of an amount of another preselected chemical compound in said liquid that has been consumed.

15. The container as in claim 14 wherein:

each indicium of said third set of linear scale indicia includes two corresponding third set components, one said third set component being color indicia and another said third set component being shape indicia; and said corresponding third set components being additionally imprinted adjacent a corresponding nutritional indicium of said plurality of nutritional indicia, whereby to associate said corresponding nutritional indicium with said third sets of linear and graduated numerical scale indicia.

16. The container as in claim 13 further comprising:

a third set of linear scale indicia positioned on said second side wall between said bottom and said open top, each of said third set of linear scale indicia having a predetermined distance therebetween; and a third set of graduated numerical indicia positioned on said second side wall and corresponding to said third set of linear scale indicia beginning adjacent said open top of said container, said third set of graduated numerical indicia being indicative of an amount of another preselected chemical compound in said liquid that has been consumed.

17. The container as in claim 16 wherein:

each indicium of said third set of linear scale indicia includes two corresponding third set components, one said third set component being color indicia and another said third set component being shape indicia, said color and shape indicia of said third set components being different than said color and shape indicia of said second set components, respectively; and said corresponding third set components being additionally imprinted adjacent a respective nutritional indicium of said plurality of nutritional indicia, whereby to associate said respective nutritional indicium with said third sets of linear and graduated numerical indicia.

18. The claim as in claim 10 further comprising a cap releasably coupled to said container body for selectively covering said open top.

19. A container for use in selectively monitoring consumption of a volume of a liquid from the container or consumption of an amount of preselected chemical compounds in said liquid, said container comprising:

a container body having a bottom and front and back walls extending upwardly from said bottom with first and second side walls connecting said front and back walls, said front, back, first, and second side walls defining an open top;

a first set of linear scale indicia on said first side wall between said bottom and said open top, each of said first set of linear scale indicia having a predetermined distance therebetween;

a first set of graduated numerical indicia positioned on said first side wall and corresponding to said first set of linear scale indicia beginning at said open top;

a plurality of nutritional indicia positioned on said back wall of said container body, said plurality of nutritional indicia being indicative of quantities of chemical compounds in said liquid in proportional correspondence to said first set of graduated numerical indicia;

a second set of linear scale indicia positioned on said second side wall between said bottom and said open top, each of said second set of linear scale indicia having a predetermined distance therebetween;

a second set of graduated numerical indicia positioned on said second side wall and corresponding to said second set of linear scale indicia beginning adjacent said open top of said container, said second set of graduated numerical indicia being indicative of an amount of a preselected chemical compound in said liquid that has been consumed;

wherein each indicium of said second set of linear scale indicia includes two corresponding second set components, one said second set component being color indicia and another said second set component being shape indicia; and wherein said corresponding second set components being additionally imprinted adjacent a corresponding nutritional indicium of said plurality of nutritional indicia, whereby to associate said corresponding nutritional indicium with said second sets of linear and graduated numerical scale indicia.

20. The container as in claim 19 further comprising:

a third set of linear scale indicia positioned on said second side wall between said bottom and said open top, each of said third set of linear scale indicia having a predetermined distance therebetween;

a third set of graduated numerical indicia positioned on said second side wall and corresponding to said third set of linear scale indicia beginning adjacent said open top of said container, said third set of graduated numerical indicia being indicative of an amount of another preselected chemical compound in said liquid that has been consumed;

wherein each indicium of said third set of linear scale indicia includes two corresponding third set components, one said third set component being color indicia and another said third set component being shape indicia, said color and shape indicia of said third set components being different than said color and shape indicia of said second set components, respectively; and said corresponding third set components being additionally imprinted adjacent a respective nutritional indicium of said plurality of nutritional indicia, whereby to associate said respective nutritional indicium with said third sets of linear and graduated numerical indicia.

* * * * *